United States Patent [19]

Kurita

[11] 3,941,084

[45] Mar. 2, 1976

[54] AUTOMATIC TONER SUPPLYING DEVICE

[75] Inventor: Takaji Kurita, Kawachinagano, Japan

[73] Assignee: Minolta Camera Kabushiki Kaisha, Osaka, Japan

[22] Filed: Nov. 26, 1974

[21] Appl. No.: 527,426

[30] Foreign Application Priority Data

Nov. 27, 1973 Japan ..... 48-133259

[52] U.S. Cl. ..... 118/7; 118/637; 427/21

[51] Int. Cl.[2] ..... G03G 15/08

[58] Field of Search ..... 355/3 DD; 427/21; 118/7, 118/637

[56] References Cited

UNITED STATES PATENTS

| | | | |
|---|---|---|---|
| 3,572,922 | 3/1971 | Olden | 118/637 |
| 3,638,613 | 2/1972 | Klausons et al. | 118/637 |
| 3,719,165 | 3/1973 | Trachienberg et al. | 118/7 |
| 3,834,350 | 9/1974 | Hodges | 118/637 |
| 3,854,449 | 12/1974 | Davidson | 118/637 |
| 3,872,829 | 3/1975 | Rattin | 118/637 |

*Primary Examiner*—Mervin Stein
*Assistant Examiner*—Douglas Salser
*Attorney, Agent, or Firm*—Wenderoth, Lind & Ponack

[57] ABSTRACT

An automatic toner supplying device applicable to an developing apparatus for use in an electrophotographic copying machine which is based on the physical property that the amount of toner powder consumed for developing is proportional to the potential variations of magnetic brush bristles which contact the photoreceptor surface during rotation of a photoreceptor drum and a developing roller with the potential variations utilized as a toner replenishing signal for applying a bias voltage corresponding to the toner replenishing signal, through an electrical control unit, to the brush bristles formed on a toner supply roller rotatably disposed in a toner supply tank.

6 Claims, 7 Drawing Figures

AUTOMATIC TONER SUPPLYING DEVICE

Figure 1:
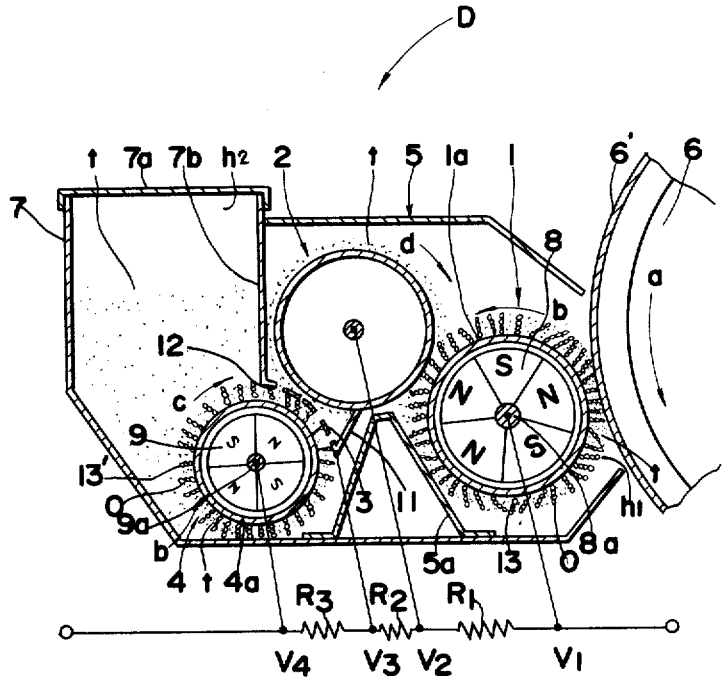

This invention relates to a toner supplying device, and more particularly to an automatic toner supplying device applicable to an electrostatic latent image developing apparatus for use in an electrophotographic copying machine.

Conventionally, in a dry copying process electrophotographic copying apparatus of xerographic or similar systems, subsequent to projection of light image of an original to be copied onto a charged photoreceptor surface to form an electrostatic latent image thereon, the latent image is developed at a developing apparatus disposed along the path of the photoreceptor by rubbing the latent image bearing portion of the photoreceptor with magnetic brush bristles of developing material comprising magnetizable carrier material and electroscopic toner powder to develop the latent image into a visible toner powder image for transfer onto a copy paper sheet.

Such conventional developing apparatus commonly includes a developing roller rotatably provided adjacent to and in spaced relation to the photoreceptor surface, which developing roller further comprises a rotatable outer cylinder and a plurality of stationary magnets fixedly disposed in the outer cylinder for the formation of the magnetic brush bristles of the developing material on the outer cylinder, with the toner powder for the developing material and consequently for the magnetic brush bristles being supplied from a toner supplying tank incorporated in a housing of the developing apparatus through stirring vanes or the like.

In such conventional developing apparatuses, there is no method for measuring the toner concentration in the magnetic brush bristles of the developing material, so that it has been a common practice to examine the copied images with naked eyes for maintaining the toner concentration in the developing material approximately constant by manually adjusting the amount of toner to be replenished, whcih procedure, however, tends to result in uneven supply of toner powder, and especially when the amount of toner to be replenished is kept constant, marked difference in the toner consumption may be caused, depending upon the ratio of white portion to black portion in the original to be copied, thus giving rise to irregular quality of the copied images.

In order to overcome such defects, various methods have been conventionally proposed, in which methods, a process for replenishing the magnetic brush bristles with toner powder by estimating the toner concentration on the basis of the dynamic or electrical properties of the developing material or a method for replenishing toner powder in accordance with the darkness of the copied images through optical measurements of such copied images is commonly known. However, such conventional methods have various disadvatages, i.e., in the former, not only the supplying device is complicated with consequent high cost, but the same tends to be affected by deterioration or fatigue of toner powder with time, while in the latter unnecessary amount of toner powder which does not correspond to the darkness of the copied images is liable to be supplied and consumed due to unstable corona discharge, by which shortcomings such conventional devices have hardly been put into practical use.

On the other hand, in one of such conventional devices, a method in which amount of charge of toner powder consumed or amount of electric current flowing according to the variations of the charge is measured, which detected amount of charge or current is fed back to control the quantity of toner powder to be replenished. However, the above described device has also such drawbacks as requiring a complicated system for the measurement of the charge and regulation of toner replenishment with consequent high cost.

Accordingly, an essential object of the present invention is to provide an automatic toner supplying device applicable to a developing apparatus which maintains the toner concentration in the developing material constant through replenishment of toner powder in proportion to the area of the latent image to be developed so as to offer copied image of uniform quality with substantial elimination of the disadvantages inherent in the conventional toner supplying devices.

Another important object of the present invention is to provide an automatic toner supplying device of the above described type which is accurate in functioning without requiring any servo mechanisms.

A further object of the present invention is to provide an automatic toner supplying device of the above described type which is simple in construction with consequent low cost.

According to a preferred embodiment of the present invention, the automatic toner supplying device comprises a developing roller rotatably disposed in a developer housing adjacent to a known photoreceptor surface of a photoreceptor drum driven by conventional means, thorugh an opening formed in the developer housing, a plurality of elongated magnetic members fixedly disposed in an annular array about a fixed core and enclosed in a rotatable outer cylinder of non-magnetic material of the developing roller for the formation of magnetic brush bristles of developing material consisting of carrier beads and toner particles on the developing roller, a toner supply roller of similar construction to the developing roller which is rotatably disposed at the lower portion of the toner supply tank incorporated in the developer housing and on which magnetic brush bristles are also formed, an offset drum of electrically conductive material rotatably disposed above and between the developing roller and the toner supply roller for transferring the toner powder on the brush bristles of the toner supplying roller onto the brush bristles of the developing roller, and an electrical control circuit electrically connected to the developing roller, toner supplying roller and the offset drum. The toner supplying device of the invention is based on the physical property that the amount of toner powder consumed for developing is proportional to the potential variations of the brush bristles which contact the photoreceptor surface during rotation of the photoreceptor drum and the developing roller, said potential variations being utilized as a toner replenishing signal for applying a bias voltage corresponding to the toner replenishing signal, through the control unit, to the brush bristles on the toner supply roller rotatably disposed in the toner supply tank. The brush bristles of the toner supply roller to which the toner replenishing signal is applied are advantageously adapted to supply, through the offset drum, the amount of toner powder approximately equal to the amount of the toner powder consumed for developing to the brush bristles of the developing roller rubbing against the photoreceptor surface.

Figure 2:
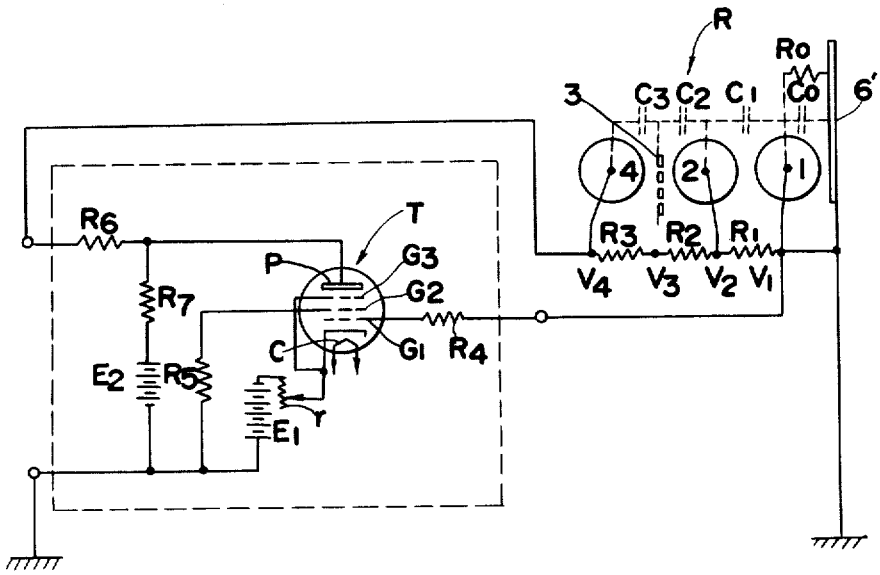
Figure 3:
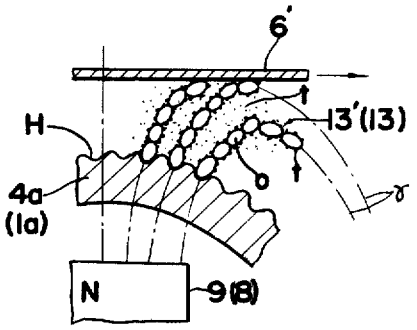
Figure 4:
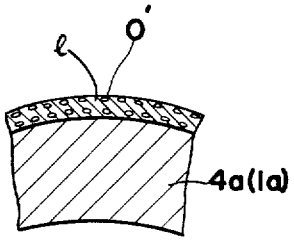
Figure 5:
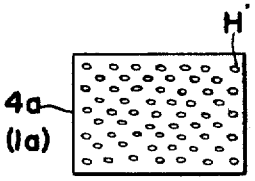
Figure 6:
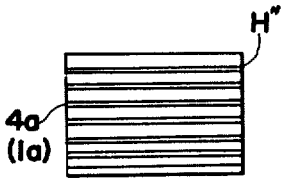
Figure 7:
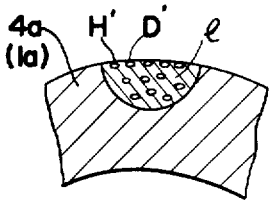

These and other objects and features of the present invention will become apparent from the following description taken in conjunction with the preferred embodiment thereof with reference to the accompanying drawings, in which;

FIG. 1 is a schematic cross sectional view of an automatic toner supplying device according to an embodiment of the invention, FIG. 2 is an electrical circuit diagram illustrating various elements of the automatic toner supplying device of the invention, FIG. 3 is a schematic cross sectional view, in partial section, explanatory of the principle of the surface finish of an outer cylinder for a toner supply roller or for a developing roller, FIG. 4 is a schematic cross sectional view, in partial section, of a modification of the surface finish of an outer cylinder for toner supply roller or for a developing roller of FIG. 1, FIG. 5 is a top plan view of a section of another modification of the surface finish of the outer cylinder for the toner supply roller or for a developing roller of FIG. 1, FIG. 6 is a similar view to FIG. 5, but shows a third modification of the surface finish of the outer cylinder for the toner supply roller or for the developing roller of FIG. 1, and FIG. 7 is a schematic cross sectional view, in partial section, of a modification of FIG. 5.

Before the description of the present invention proceeds, it is to be noted that like parts are designated by like numerals throughout the several views of the accompanying drawings.

Referring to FIGS. 1 and 2, there is shown an automatic toner supplying device D according to the present invention which is disposed adjacent to a known photoconductive photoreceptor drum 6 having a photoreceptor surface 6′ on the outer periphery thereof and rotated in the direction of an arrow a by conventional means. The toner supplying device D for developing an electrostatic latent image formed on the photoreceptor surface 6′ extends the width of the surface 6′ and is substantially enclosed in a developer housing 5 except for an opening *h*1 adjacent to the photoreceptor surface 6′ whereat the development of the latent image formed on the surface 6′ is effected, and an opening *h*2 for a toner supply tank 7 which is covered with a releasable cover 7*a* except when it is necessary to replenish the tank 7 with fresh toner powder. A developing roller 1 is rotatably provided, at the left portion in the housing 5 in FIG. 1, adjacent to and in close spaced relationship relative to the photoreceptor surface 6′ through the opening *h*1, which roller 1 comprises an outer cylinder 1*a* of a non-magnetic material nearly extending the width of the housing 5 and rotatably journaled in the side walls (not shown) of said housing 5 so as to be rotated by suitable driving means (not shown).

The outer periphery of the outer cylinder 1*a* should preferably be formed with many small concave portions for friction increasing finish so as to prevent slippage of magnetic brush bristles to be formed on the cylinder 1*a* during developing.

In the outer cylinder 1*a*, five elongated magnetic members 8 are fixedly disposed in an annular array about and extending along a fixed core or bar 8*a* with alternately different polar orientations, and consequently with two of the magnetic member 8 remote from the surface 6′ having the same polar orientation. Accordingly, upon rotation of the outer cylinder 1*a* in the direction of an arrow *b*, magnetic brush bristles 13 of developing material are formed on the outer periphery of the cylinder 1*a*. The magnetic brush bristles 13 of the developing material comprise magnetizable carrier beads 0 having average diameters in the region from 50$\mu$ to 500$\mu$, to which beads 0 a predetermined amount of toner particles *t* are adhered in the developer housing 5, so that the tips of the brush bristles 13 rub, as the cylinder 1*a* and the photoreceptor drum 6 rotate, against the latent image formed portion on the photoreceptor surface 6′ for developing the latent image into a visible toner powder image.

On the other hand, a toner supply roller 4 is rotatably provided at the left portion in the housing 5 of FIG. 1, in a position below the lower edge of the partition 7*b* fixedly provided between the housing 5 and the toner supply tank 7, whereat the housing 5 communicated with the tank 7. The toner supply roller 4 which is of similar construction to the developing roller 1 comprises a rotatable outer cylinder 4*a* extending the width of the photoreceptor 6′ and enclosing therein four elongated magnetic members 9 fixedly mounted in an annular array on a bar 9*a* with alternately different polar orientations. Upon rotation of the cylinder 4*a* in the direction of an arrow *c*, magnetic brush bristles 13′ of carrier material 0 are also formed on the outer periphery of the cylinder 4*a*, but since the roller 4 is disposed below the toner supply tank 7, the toner powder *t* adhering to the brush bristles 13′ is of such high concentration that it can not be directly used for developing.

It should be noted here that, although the carrier beads 0 for the magnetic brush 13′ may be of the same as those for the brush 13 of the developing roller 1, such inconveniences as slipping of carrier beads 0 relative to the outer periphery of the cylinder 4*a* tend to occur as the cylinder 4*a* rotates in the toner powder *t*, if the particle size of the carrier beads 0 is too small, so that when carrier beads of extremely small diameters are employed for the carrier beads 0 for the magnetic brush 13′, magnets having large magnetic force must be used for the magnetic members 9, or otherwise, some countermeasures for increasing friction on the outer periphery of the cylinder 4*a*, such as embedding magnetizable particles having average diameters from 10$\mu$ to 500$\mu$ in the outer periphery of the cylinder 4*a* etc., are required as described hereinbelow.

It should also be noted that such magnetizable carrier beads should preferably be embedded in the outer periphery of the outer cylinder 1*a* for the roller 1 also for preventing slippage of the brush bristles 13 relative to the outer cylinder 1*a* due to friction between the bristles 13 and the photoreceptor surface 6′, although the description hereinbelow is mainly made on the cylinder 4*a* for the toner supply roller 4.

Referring now to FIGS. 4 to 6, there are shown modifications of the finish for increasing friction on the outer periphery of the cylinder 4*a* of FIG. 1.

Before the description of the above modifications of the invention proceeds, it is to be noted that these modifications in FIGS. 4 to 6 are based on the fact described below.

In FIG. 3 the provision of the concave portions H on the outer periphery of the outer cylinder 4*a* for increasing friction between the carrier beads 0 carrying toner particles *t* of the developing material and the surface of the cylinder 4*a* still allows the magnetic brush bristles 13' to slip off the surface of the cylinder 4*a* to a certain extent due to frictional force resulting from the contact of the brush 13' with the toner powder *t* in the tank 7 if the speed of rotation of the outer cylinder 4*a* is increased, even in which case, however, the brush bristles 13' still remain formed approximately along the magnetic lines of force $\gamma$ of the magnetic members 9. This is because each of the carrier beads 0 is magnetized by the magnetic force of the magnets 9 and is formed into a small magnet with the attraction between the carrier beads 0 being larger than the attraction between the carrier beads 0 and the outer cylinder 4*a*.

In FIG. 4, a mixture of magnetizable particles 0' of iron, iron oxide or various kinds of ferrite particles having diameter 10 to 500$\mu$ and a bonding material *l* of alkyd resin, acrylic resin, polyvinyl acetate, or thermosetting epoxy resin with the quantity rate of the latter being in the range of 1/5 to 1/10 of the former by weight is diluted by a resin solvent and applied onto the surface of the outer cylinder 4*a* to the thickness of approximately 0.05 to 0.5mm with subsequent drying so as to fix the magnetizable particles 0' closely scattered on the surface of the cylinder 4*a*.

By the above arrangement, since the fixed magnetizable particles 0' are magnetized by the stationary magnets 9 so as to form small magnets which locally disturb the magnetic field on the surface of the cylinder 4*a* and attract the carrier beads 0 of the magnetic brush bristles 13' as strongly as in the attraction between the carrier beads 0 in the brush bristles 13', no slipping between the brush bristles 13' and the surface of the cylinder 4*a* is caused even when the brush bristels 13' contact the toner powder *t* in the tank 7.

Furthermore, in the above modification of the invention, as the brush bristles are positively formed at the positions of the fixed magnetizble particles 0' magnetized in advance, the density of the formed brush bristles is much higher than in conventional means so as to carry sufficient quantity of toner powder together with the effect of preventing slippage of the brush bristles.

In FIGS. 5 and 6, many concave portions or dints H' or spline H'' are formed on the entire outer periphery of the cylinder 4*a* instead of the layer of the mixture of the magnetizable particles 0' and the bonding material *l* uniformly formed on the cylinder 4*a* in the modification in FIG. 4. The dints H' or the spline H'' are filled with the mixture of magnetizable particles 0' and bonding material *l* as shown in FIG. 7 with the excessive mixture on the surface of the cylinder 4*a* wiped off thereafter, thus, fixing the particles 0' scattered in the dints H' or the spline H''.

It should be noted here that the proper depth of each of the dints H' or the spline H'' is in the region from 0.1 to 3mm, and that the dints H' should be formed evenly the entire surface of the cylinder 4*a* toward the direction of rotation of the cylinder 4*a*, for example, in a zigzag pattern.

In the above modifications in FIGS. 4 to 6, it is necessary to employ the magnetizable particles 0' with diameter equal to or slighly larger than the diameter of the carrier beads 0 for the brush bristles 13', and also to properly scatter the magnetizable particles 0' so as not to reduce the magnetic force of the stationary magnets 9 through the cylinder 4*a* by a shielding action of the fixed particles 0'. If the surfaces of the magnetizable particles 0' are adapted to be exposed on the surface of the cylinder 4*a*, the magnetic force of the particles 0' is strengthened with improved attraction toward the carrier beads 0 for magnetic brush formation.

As is clear from the above description, according to the modifications of the surface finish of the outer cylinder of the invention shown in FIGS. 4 to 6, the slippage of the magnetic brush bristles formed on the rotating outer cylinder is advantageously prevented by simply scattering magnetizable carrier particles on the entire surface of the outer cylinder or in the concave portions formed on the outer periphery of the outer cylinder, which surface finish provides an outer cylinder particularly suitable for high speed development.

If the above modifications of FIGS. 4 to 6 are applied to the outer cylinder 1*a* for the developing roller 1, not only the slippage of the brush bristles 13 relative to the outer cylinder 1*a* due to friction between the bristles 13 and the photoreceptor surface 6' during rotation of the roller 1 and the drum 6 is minimized, but also the high density of the formed brush bristles provides sufficient quantity of developing material to the developing position, thus eliminating the possibility of producing copied image of excessively light shade.

It should also be noted that the magnet members 9 as described stationary within the outer cylinder 4*a* may be adapted to rotate together with the outer cylinder 4*a*, and that the number of the magnets 9 or 8 may be increased or decreased developing upon the purpose.

Referring back to FIGS. 1 and 2, a cylindrical offset drum 2 of electrically conductive material is rotatably provided between and slightly above the developing roller 1 and the toner supplying roller 4 with a blade 11, for example, a doctor blade, disposed in sliding contact with the outer periphery of the drum 2 at the lower portion of the drum 2 for scraping residual toner powder off the latter, and with a mesh grid 3 fixedly disposed between the off set drum 2 and the roller 4.

A slit 12 is formed between the lower edge of the partition plate 7*b* and the outer periphery of the roller 4, while a partition plate 5*a* formed into an approximately triangular cross section fixedly disposed between the developing roller 1 and the toner supply roller 4.

During developing operation, the developing roller 1 rotates in the direction of the arrow *b*, the toner supplying roller 4 in the direction of the arrow *c*, and the offset drum 2 in the direction of an arrow *d*, while the photoreceptor drum 6 rotates in the direction of the arrow *a*, with biasing voltages V1, V2, V3, and V4 corresponding to resistors R1, R2, and R3 being applied to the roller 1, the roller 4, the drum 2 and the mesh grid 3 respectively through control unit R shown in FIG. 2, which is mentioned later.

Accordingly, on the supposition that the electrostatic latent image formed on the photoreceptor surface 6' is of negative charge, when the brush bristles 13 formed on the outer periphery of the developing roller 1 rub against the surface 6' as the roller 1 and the drum 6 rotate, the toner particles *t* attracting to the carrier beads 0 in the brush bristles 13 adheres to the latent image formed portion on the photoreceptor surface 6' in proportion to the electric potential and area of the latent image, by which, part of the charge of the latent image moves through the carrier beads 0 of the brush bristles 13 with an electric current flowing through the carrier beads 0 of the bristles 13 due to movement of the charged toner particles *t* toward the latent image formed surface 6', while variation in potential is produced by the charge induced in the carrier beads 0 of the bristles 13 due to capacity between the latent image formed surface 6' and the brush bristles 13. Accordingly, the potential of the brush bristles 13 deviates to negative side, and the amount of deviation is proportional to the charge of the latent image with which the bristles 13 contact, i.e., to the potential and the area of the latent image.

On the other hand, since the amount of the toner powder *t* adhering to the latent image formed portion of the photoreceptor surface 6' is also in proportion to the potential and the area of the latent image formed portion on the photoreceptor surface 6', the potential variation induced in the brush bristles 13 is consequently proportional to the amount of the toner powder *t* adhering to the bristles 13. It is one of the outstanding features of the present invention that, by applying to the brush bristles 13' formed on the toner supply roller 4 which rotates in the toner powder *t* of the tank 7 a potential of opposite polarity which will cancel the potential variation in the brush bristles 13 on the developing roller 1, the toner powder *t* is adapted to be supplied onto the latent image formed portion of the photoreceptor surface 6' depending on the above potential difference.

Accordingly, each of the developing roller 1, the toner supplying roller 4, the offset drum 2 and the mesh grid 3 should suitably be supported by an insulating material in the housing 5.

Since charge induced in the magnetic brush bristles 13 on the developing roller 1 by the charge of the latent image is in the region between $10^{-8}$ and $10^{-6}$ coulomb in the development employing commonly used copying apparatuses, biasing voltage for cancelling the potential variation in the brush bristles 13 on the developing roller 1 can be applied to the brush bristles 13' on the toner supply cylinder 4 through control means, for example, a control unit R as shown in FIG. 2, in which unit R, voltage proportional to the potential variation in the brush bristles 13 on the roller 1 is impressed on the brush bristles 13' on the roller 4 rotating in the toner powder *t* and the mesh grid 3, and also between the mesh grid 3 and the offset drum 2, and according to the resultant potential difference therefrom, the charged toner particles *t* carried by the brush bristles 13' on the rotating roller 4 are supplied onto the outer periphery of the offset drum 2 through the mesh grid 3. The toner particles *t* adhered to the outer periphery of the offset drum 2 are adapted to contact the carrier beads 0 of the bristles 13 on the developing roller 1 during rotation of the drum 2 and the roller 1 with most of the toner particles *t* on the drum 2 adhering to the bristles 13 on the roller 1. In other words, the biasing voltages V4, V3 and V2 vary directly with the variation of the potential variation of the bristles 13 on the roller 1 for controlling the amount of the toner powder *t* to be supplied for the development of the latent image on the photoreceptor 6'.

Referring particularly to FIG. 2, the function of the control unit R for controlling the amount of toner powder *t* will be described hereinbelow.

The photoreceptor surface 6' of the photoreceptor drum 6 is electrically earthed, and simultaneously connected electrically to the developing roller 1 through contact thereof with the brush bristles 13 on the roller 1 by an equivalent resistance R0. Electrostatic capacity C0 between the photoreceptor drum 6 and the developing roller 1, electrostatic capacity C1 between the roller 1 and the offset drum 2, electrostatic capacity C2 between the offset drum 2 and the mesh grid 3 and electrostatic capacity C3 between the mesh grid 3 and the toner supplying roller 4 are shown in dotted lines respectively. The developing roller 1 with the brush bristles 13 formed thereon is connected to a control grid G1 of a vacuum tube T through a resistor R4 and simultaneously to a plus terminal of a bias voltage source E2 through distributing resistances R1, R2 and R3 and also resistances R6 and R7. The distributing resistance R1 is for connecting the roller 1 and the offset drum 2, the distributing resistance R2 for connecting the offset drum 2 and the mesh grid 3, and the distributing resistance R3 for connecting the mesh grid 3 and the roller 4. The minus terminal of a biasing voltage source E1 is connected to a cathode C, and the third grid G3 of the vacuum tube T through a variable resistor *r*, while the plus terminal of the voltage source E1 is connected, through a resistance R5, to the second grid G2 of the tube T, and also to the minus terminal of the biasing voltage source E2 and is then earthed. The plate P of the vacuum tube T is connected to a lead between the resistances R6 and R7. In the embodiment of FIG. 2, wherein the photoreceptor surface 6' of the drum 6 is negatively charged, the biasing voltage E1 is −300V, the biasing voltage E2 is +200V, the resistance R4 is of 10MΩ, the resistance R5 is of 1MΩ, the resistance R6 is of 5MΩ, and the resistance R7 is of 500KΩ. Moreover, the biasing voltages V1, V2, V3 and V4 to be applied to the developing roller 1, the offset drum 2, the mesh grid 3 and the toner supply roller 4 can be adjusted by suitably selecting the values of the biasing voltages E1 and E2, and the resistances R1, R2 and R3.

The voltage for the biasing voltage source E1 is determined taking into account the residual potential and the residual toner on the photoreceptor surface 6' of the photoreceptor drum 6 on the basis of the potential of the bursh bristles 13 on the roller 1 in the state where a predetermined amount of toner powder *t* necessary for the development is contained in the brush bristles 13.

By this arrangement, when the brush bristles 13 of the developing roller 1 rub against the charged latent image formed on the photoreceptor surface 6' as the roller 1 and the drum 6 rotate with the toner powder *t* in the brush bristles 13 moving onto the photoreceptor surface 6', the potential of the brush bristles 13 on the roller 1 is raised up to a level higher than a set voltage of the biasing voltage source E1. Accordingly, the voltage of the biasing source E1 does not affect the brush bristles 13' of the toner supply roller 4, and only the voltage of the biasing voltage source E2 (opposite polarity to that of the voltage source E1) is applied to the magnetic brush bristles 13' of the roller 4 with the potential difference V4-V2 between the brush bristles 13' and the offset drum 2 being increased. Consequently, the toner powder *t* adhering to the brush bristles 13' on the roller 4 moves onto the offset drum 2, so that approximately the same amount of toner powder as that consumed for developing is supplied to the brush bristles 13 on the developing roller 1. Simultaneously, the biasing voltage E2 applied to the brush bristles 13' on the roller 4 is also applied to the bristles 13 on the roller 1 with the induced potential cancelled. On the other hand, in cases where the toner powder *t* does not move onto the photoreceptor surface 6', there is no potential variation of the bristles 13 of the roller 1 with potential thereof being less than the biasing voltage E1 and with the voltage of the biasing source E1 directly applied to the bristles 13′ of the roller 4. Consequently, no potential difference is caused between the bristles 13′ of the roller 4 and the offset drum 2 without any transfer of charged toner particles *t* from the bristles 13′ of the roller 4 onto the offset drum 2. As is seen from the above description, the control unit R is adapted to stabilize the potential on the bristles 13 of the developing roller 1, forming a simple potential stabilizing circuit.

It should be noted here that the present invention is not limited to the above described embodiment, but that any construction will serve the purpose of the invention in which the biasing voltage applied to the magnetic brush bristles of the toner supply roller rotatably provided in the toner supply tank can be controlled by the potential variations of the magnetic brush bristles of the developing roller which rotates with the brush bristles thereof contacting the latent image bearing photoreceptor surface of the photoreceptor drum. For example, the mesh grid 3 described as employed in the embodiment of FIG. 1 may be dispensed with so that the toner particles *t* on the brush bristles 13′ of the toner supply roller 4 directly adhere to the outer periphery of the offset drum 2.

As is clear from the foregoing description, in the automatic toner supplying device of the invention, the potential variations of the magnetic brush bristles on the developing roller at the time when said brush bristles rub against the latent image bearing photoreceptor surface for adhering the toner powder to the latter as the developing roller and the photoreceptor drum rotate are advantageously utilized for the control of the amount of toner powder to be supplied without requiring any particular detector or the like, by which potential variations the biasing voltage applied to the magnetic brush bristles of the toner supply roller rotatably disposed in the toner supply tank is efficiently varied, so that the desired amount of toner powder is supplied onto the electrostatic latent image formed on the photoreceptor surface for optimum development of the latent image.

Furthermore, the magnetizable carrier particles embedded in the outer periphery of the toner supply roller or the developing roller described as employed in the modification of FIGS. 4 to 7 are particularly effective not only for increasing the adhesion of the developing material to the roller surface, but for preventing the slippage of the magnetic brush bristles relative to the roller surface, thus contributing much to offering clear and definite copied images and also to high speed copying.

Although the present invention has been fully described by way of example with reference to the attached drawings, it is to be noted that various changes and modifications are apparent to those skilled in the art. Therefore, unless otherwise such changes and modifications depart from the scope of the present invention, they should be construed as included therein.

What is claimed is:

1. An automatic toner supplying device for use in an electrophotographic copying machine which comprises a developing roller rotatably disposed in a developer housing adjacent to a photoreceptor surface of a photoreceptor drum, through an opening formed in said developer housing, magnet means enclosed in a rotatable outer cylinder of said developing roller for formation of magnetic brush bristles of developing material consisting of carrier beads and toner particles on an outer periphery of said outer cylinder, said magnetic brush bristles being adapted to rub against a latent image formed portion on said photoreceptor surface for developing said latent image into a visible toner powder image, a toner supply roller with which carrier beads are adhered rotatably disposed at a lower portion of a toner supply tank incorporated in said developer housing and on which magnetic brush bristles are also formed through magnet means enclosed in said toner supply roller, an offset drum of electrically conductive material rotatably disposed between said developing roller and said toner supply roller for transferring toner particles on said brush bristles of said toner supply roller onto said brush bristles of said developing roller and an electrical control circuit connected to said developing roller, said toner supplying roller and said offset drum, said toner particles consumed for said development being proportional, in amount thereof, to potential variations of said brush bristles which contact said photoreceptor surface during rotation of said photoreceptor drum and said developing roller, said potential variations being utilized as a toner replenishing signal for applying a bias voltage corresponding to said toner replenishing signal, through said control circuit, to said brush bristles formed on said toner supply roller, which brush bristles are adapted to supply, through said offset drum, an amount of toner particles approximately equal to said amount of said toner particles consumed for said developing, to said brush bristles of said developing roller.

2. An automatic toner supplying device as claimed in claim 1, wherein a mesh grid supported by insulating material is fixedly provided in a space between said outer peripheries of said toner supply roller and said offset drum.

3. An automatic toner supply device as claimed in claim 1, wherein said magnet means enclosed in said developing roller and said toner supply roller each comprises an elongated single magnet member fixedly disposed on a core.

4. An automatic toner supply device as claimed in claim 1, wherein said magnet means enclosed in each of said developing roller and said toner supply roller comprises a plurality of elongated magnet members.

5. An automatic toner supply device as claimed in claim 1, wherein said outer peripheries of said developing roller and said toner supply roller are further treated with a mixture of magnetizable particles and a bonding material for fixing said magnetizable particles closely scattered on said outer peripheries of said developing roller and said supply roller.

6. An automatic toner supply device as claimed in claim 1, wherein said developing roller, said offset drum and said toner supply roller are each supported by an insulating member.

* * * * *